US008225541B2

(12) United States Patent
Bigley et al.

(10) Patent No.: US 8,225,541 B2
(45) Date of Patent: Jul. 24, 2012

(54) MAGAZINE FOR A FIREARM

(75) Inventors: John M. Bigley, West Simsbury, CT (US); Shawn H. Russell, Bristol, CT (US)

(73) Assignee: Okay Industries, Inc., New Britain, CT (US)

( * ) Notice: Subject to any disclaimer, the term of this patent is extended or adjusted under 35 U.S.C. 154(b) by 383 days.

(21) Appl. No.: 12/685,872

(22) Filed: Jan. 12, 2010

(65) Prior Publication Data

US 2011/0167694 A1 Jul. 14, 2011

(51) Int. Cl.
*F41A 9/61* (2006.01)

(52) U.S. Cl. ..... 42/49.01

(58) Field of Classification Search ..... 42/49.01, 42/49.02, 50, 11, 17, 21, 24, 29, 33, 35, 37, 42/39; 89/197, 33.1
See application file for complete search history.

(56) References Cited

U.S. PATENT DOCUMENTS

| | | | | | |
|---|---|---|---|---|---|
| 1,323,063 | A | * | 11/1919 | Johnson et al. | 42/50 |
| 3,440,751 | A | * | 4/1969 | Fremont | 42/50 |
| 3,453,762 | A | * | 7/1969 | Fremont | 42/50 |
| 4,139,959 | A | * | 2/1979 | Howard et al. | 42/50 |
| 4,472,900 | A | * | 9/1984 | Howard | 42/50 |
| 5,058,301 | A | | 10/1991 | Lishness et al. | |
| 5,263,273 | A | | 11/1993 | Lishness | |
| 5,287,720 | A | | 2/1994 | Lishness | |
| 5,345,660 | A | | 9/1994 | Howard | |
| 5,495,687 | A | * | 3/1996 | Waiser | 42/50 |
| 5,615,506 | A | | 4/1997 | Jackson et al. | |
| 5,638,626 | A | | 6/1997 | Westrom | |
| 5,704,148 | A | | 1/1998 | Valorose | |
| 5,845,426 | A | | 12/1998 | Valorose | |
| 5,956,878 | A | * | 9/1999 | Yang | 42/50 |
| 6,370,806 | B1 | * | 4/2002 | Klebes et al. | 42/84 |
| 6,810,616 | B2 | | 11/2004 | Tal et al. | |
| 7,059,077 | B2 | | 6/2006 | Tal et al. | |
| 7,117,626 | B1 | | 10/2006 | Alzamora et al. | |
| 7,200,963 | B1 | * | 4/2007 | Vieweg et al. | 42/49.01 |
| 7,200,964 | B2 | * | 4/2007 | Gates | 42/50 |
| 7,373,751 | B1 | | 5/2008 | Schaffer | |
| 7,428,795 | B2 | | 9/2008 | Herring | |
| 7,441,491 | B2 | | 10/2008 | Snow | |
| 7,497,044 | B2 | | 3/2009 | Cammenga et al. | |
| 7,509,767 | B2 | | 3/2009 | Bolen | |
| 7,533,483 | B1 | * | 5/2009 | Alzamora et al. | 42/50 |
| 7,533,783 | B2 | | 5/2009 | Choi et al. | |
| D593,633 | S | | 6/2009 | Fitzpatrick et al. | |
| D593,635 | S | | 6/2009 | Fitzpatrick et al. | |
| D600,303 | S | | 9/2009 | Fitzpatrick et al. | |

(Continued)

FOREIGN PATENT DOCUMENTS

WO 2008140833 11/2008

*Primary Examiner* — Jonathan C Weber
(74) *Attorney, Agent, or Firm* — Cantor Colburn LLP

(57) ABSTRACT

A magazine for a firearm is provided. The magazine includes a magazine box, a base removably coupled to the magazine box and a follower disposed in the magazine box. A spring is coupled to said follower to bias ammunition cartridges towards a firearm receiver. The base includes at least one opening sized to receive an arm on said follower when the magazine is loaded with ammunition cartridges. The distance between the bottom of the follower and top of the base may be arranged to be less than the diameter of an ammunition cartridge when the magazine contains a predetermined number of rounds.

19 Claims, 12 Drawing Sheets

U.S. PATENT DOCUMENTS

| | | | | |
|---|---|---|---|---|
| 7,621,063 | B2 * | 11/2009 | Fitzpatrick et al. | 42/50 |
| 7,908,780 | B2 * | 3/2011 | Fitzpatrick et al. | 42/50 |
| 7,958,660 | B2 * | 6/2011 | Fitzpatrick et al. | 42/50 |
| 8,006,423 | B1 * | 8/2011 | Alzamora et al. | 42/49.01 |
| 8,069,601 | B1 * | 12/2011 | Fitzpatrick et al. | 42/50 |
| 2007/0157501 | A1 | 7/2007 | Cammenga et al. | |
| 2008/0127539 | A1 | 6/2008 | Schaffer | |
| 2009/0044440 | A1 | 2/2009 | Tal et al. | |
| 2009/0107022 | A1 | 4/2009 | Fitzpatrick et al. | |
| 2010/0281737 | A1 * | 11/2010 | Cahill | 42/50 |
| 2011/0005113 | A1 * | 1/2011 | Fitzpatrick et al. | 42/1.02 |
| 2011/0214326 | A1 * | 9/2011 | Inskeep et al. | 42/49.02 |

* cited by examiner

MAGAZINE FOR A FIREARM

BACKGROUND OF THE INVENTION

The subject matter disclosed herein relates to a magazine for a firearm and in particular to a magazine for a firearm that holds a predetermined number of cartridges and has a follower that reduces the potential of the magazine malfunctioning.

Firearms having multi-round capabilities typically utilize an interchangeable magazine that holds a predetermined number of ammunition cartridges. Users typically preload several magazines, so that as a magazine becomes depleted during use, the user can quickly exchange the empty magazine with a full one. This allows user to quickly resume using the firearm with minimal downtime.

Magazines come in a number of sizes, such as magazines holding 20 cartridges or 30 cartridges for example. Some states have passed regulations limiting the number of rounds that a civilian firearm can possess. Typically, these regulations limit the magazine to ten cartridges. One problem encountered by firearm manufacturers is that users may perform unauthorized modifications of the magazine to allow the magazine to hold a larger number of cartridges than may be allowed. As a result, federal and state agencies have often banned the sale of magazines, or firearms using the magazines, that can be modified to accept more than the legally allowed number of cartridges.

Magazines have several components, such as a magazine box that holds the cartridges and a follower that moves the cartridges into the firearm receiver. The follower is typically arranged in the magazine box and is biased by a spring towards the firearm receiver. One potential issue that arises is the tilting or skewing of the follower as it travels within the magazine box. The tilting of the follower may cause an undesirable condition where the cartridges jam within the magazine box. When this occurs, further use of the firearm is prevented until the user removes the magazine, re-aligns the cartridges, and re-installs the magazine on the firearm. It should be appreciated that the jamming of the magazine may greatly slow down the usage of the firearm by the user.

While existing magazines for firearms are suitable for their intended purpose, there remains a need for improvements, particularly in reducing or eliminating the possibility of an end user modifying the magazine to accept more cartridges and in reducing the probability of cartridges dislodging in the magazine box.

BRIEF DESCRIPTION OF THE INVENTION

According to one aspect of the invention, a magazine for a firearm is provided. The magazine includes a base having a first side and a second side. The base further having a first opening and a second opening extending generally parallel to the first side and the second side. A magazine box is removably coupled to the base and is sized to receive a predetermined number of ammunition cartridges. A follower is movably disposed in the magazine box between a first position and a second position, the follower having a first arm and a second arm, wherein the first arm and the second arm are arranged in the first opening and the second opening when the follower is in a first position. A biasing member is arranged between the follower and the base.

According to another aspect of the invention, a magazine for a firearm is provided having a base with a first side, a second side and a first end extending between the first side and the second side. The first side of the base having a first slot adjacent the first end and the second side having a second slot adjacent the first end. The base further having a third slot extending transverse to the first slot. A magazine box is slidably coupled to the base, the magazine box having a first projection and a second projection extending from one end. The first projection and the second projection being sized to be received in the first slot and the second slot, the magazine box further having a tab extending from the first projection on an angle towards the second projection. The tab being arranged to be received in the third slot when the magazine box is coupled to the base. A follower is disposed in the magazine box. A biasing member is coupled to the follower and arranged between the follower and the base.

According to yet another aspect of the invention, a magazine for a firearm is provided having a base. The base has a first side and an opposing second side, a first end and an opposing second end disposed between the first side and the second side, and a third end disposed in communication with the first side, the second side, the first end and the second end. The third end having a first opening an a second opening therein. The base further includes a first slot in the first side and a second slot in the second side, the first slot and the second slot each having an open end adjacent the first end, and the base having a third slot in the first side, the third slot being arranged substantially perpendicular to the first slot. A magazine box having an ammunition cartridge volume sized to receive a predetermined number of ammunition cartridges, the magazine box having a first projection and a second projection arranged on one end, the first projection and the second projection being sized to be received in the first slot and the second slot, the first projection and the second projection defining a third opening sized to receive the third end. A follower is movably disposed in the ammunition cartridge volume between a first position and a second position, the follower having a first arm and a second arm. The first arm and the second arm are arranged in the first opening and the second opening when the follower is in the first position and are substantially in the ammunition cartridge volume when the follower is in the second position. A biasing member is disposed between the follower and the third end.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
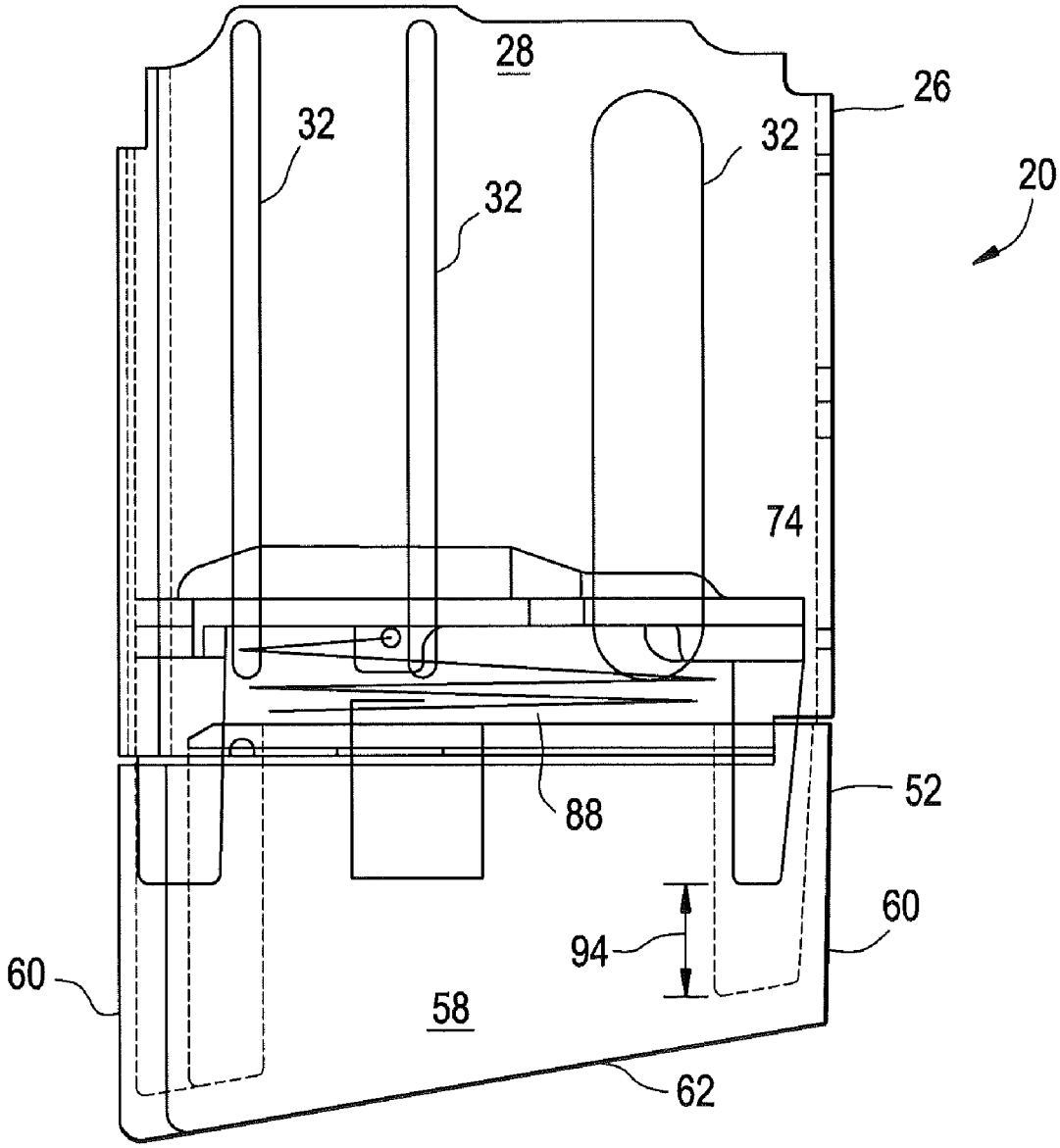
FIG. 1 is side plan view illustration of a magazine in accordance with an embodiment of the invention.
Figure 2:
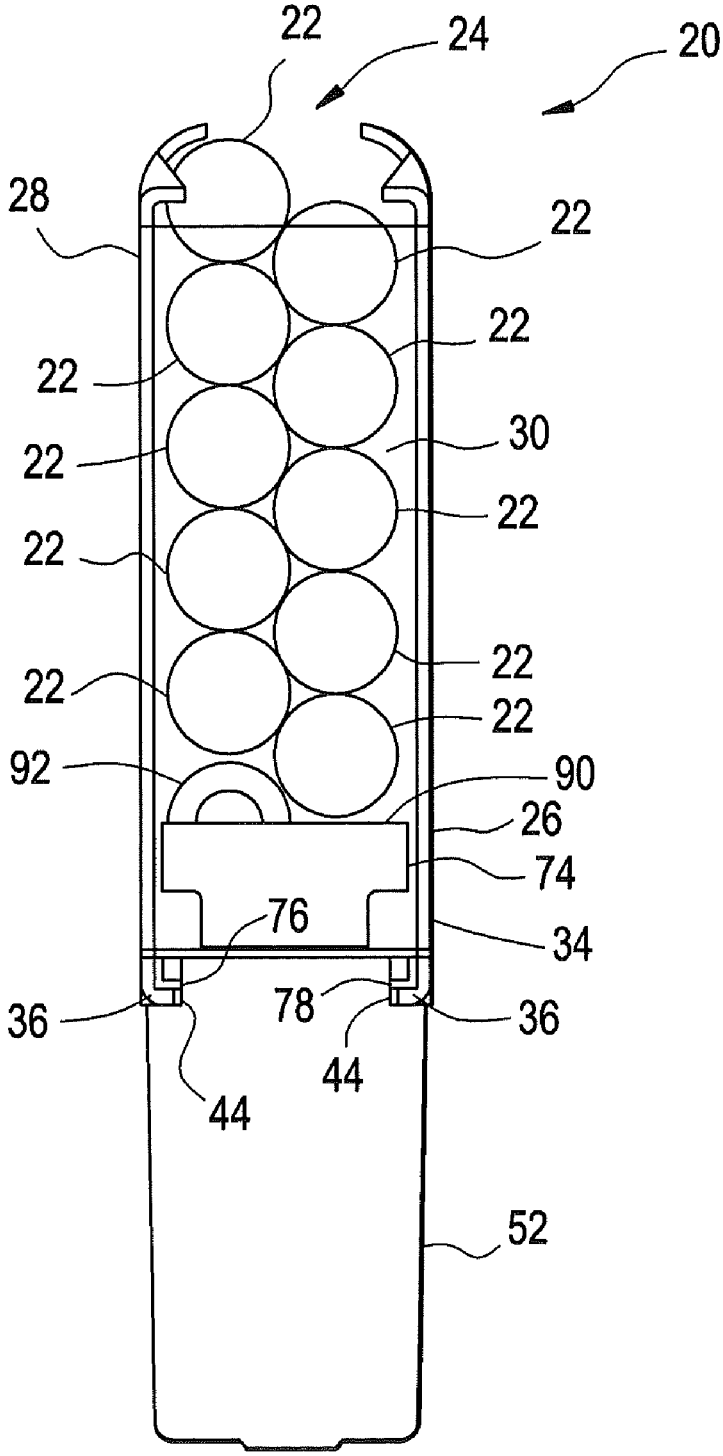
FIG. 2 is a front plan view illustration of the magazine of FIG. 1.
Figure 3:
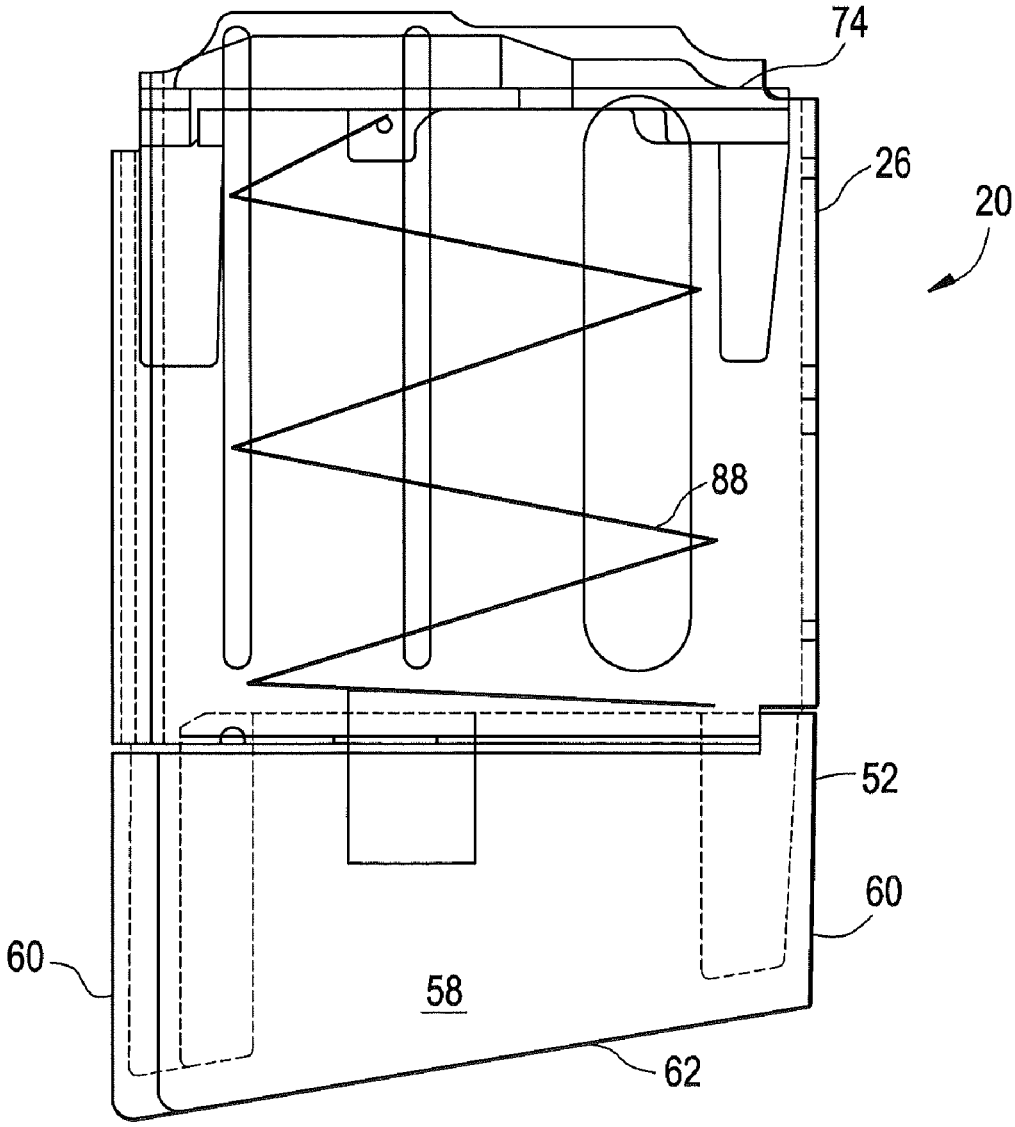
FIG. 3 is a side plan view illustration of the magazine of FIG. 1 with the follower in an extended position.

FIG. 1 and FIG. 2 illustrate an exemplary embodiment of the magazine 20 for a firearm (not shown). While the magazine 20 may be described herein with respect to a rifle, such as an M-16 or an AR-15 type of rifle for example, the claimed invention should not be so limited and the magazine 20 may be used with any type of firearm. As will be discussed in more detail below, the magazine 20 is refillable by the user. Magazines 20 of this type are generally interchangeable within a particular model firearm such that the user may fill several magazines with ammunition cartridges 22 (FIG. 2). During use, the cartridges 22 are moved by a follower 74 and exit through a top opening 24 in a magazine box 26, at which point the cartridge 20 moves into the receiver section of the firearm (not shown). When the magazine 20 is depleted the follower 74 is disposed adjacent the opening 24 as shown in FIG. 3. The user may desire to exchange the depleted magazine 20 for a full magazine 20. It should be appreciated that the magazine 20 is intended to hold a predetermined number of cartridges 22, such as ten cartridges for example.

The magazine 20 has a magazine box 26 that is configured to be received by the firearm. The magazine box 26 includes the opening 24 and is generally formed from a metal material, such as steel for example. The magazine box 26 may be made from sheet metal that form walls 28 that define a generally hollow interior portion 30. The magazine box 26 may include a number of features, such as recesses 32 for example, that allow the magazine box 26 to guide the cartridges into a proper position within the magazine box 26.

Figure 8:
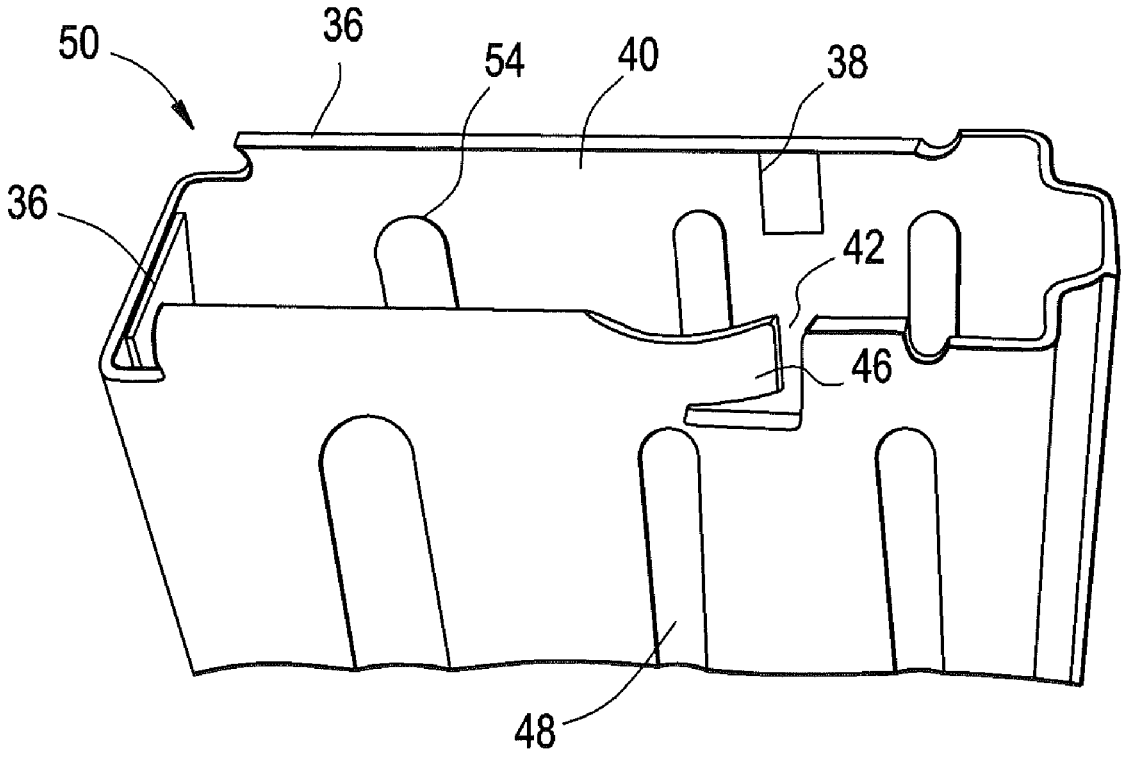
FIG. 8 is a partial perspective view illustration of the magazine box of the magazine of FIG. 1.

On one end 34 of the magazine box 26, the walls 28 turn inward towards the interior portion 30 to form a tab or projection 36. In one embodiment, the projections 36 are substantially perpendicular to the walls 28. The projections 36 define an opening 54 (FIG. 8) that is sized to receive a base 52. As shown in FIG. 8, adjacent the projections 36, the magazine box 26 also includes a tab 38. The tab 38 has a portion 40 connected to one wall 28 and an end 42. The tab 38 extends from wall 28 on an angle towards the interior portion 30. In one embodiment, the tab 38 is integral with the wall 28 and is defined by a first slot 46 and a second slot 48 in wall 28. In another embodiment, the end 42 is coplanar with an end 44 of projection 36. Magazine box 26 further includes a notch portion 50 arranged on the end 34 adjacent the projections 36. As will be discussed in more detail below, the projections 36, tab 38 and notch portion 50 cooperate with features on the base 52 to removably couple the base 52 to the magazine box 26.

Figure 9:
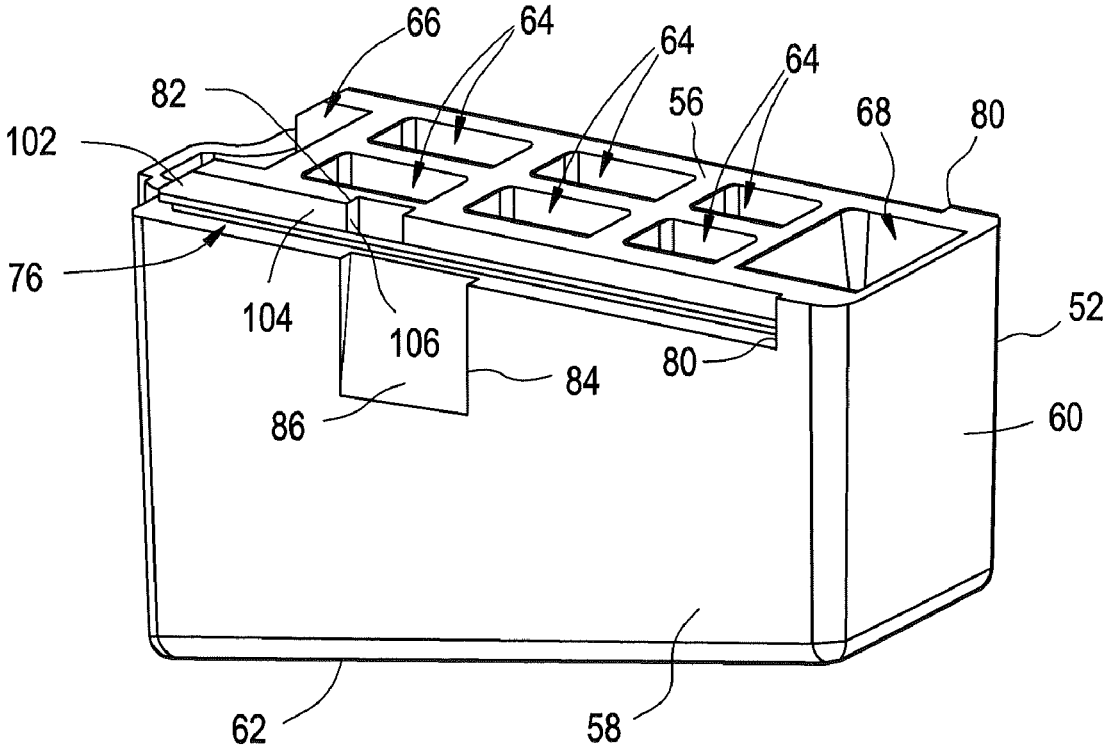
FIG. 9 is a perspective view illustration of the base of the magazine of FIG. 1.
Figure 10:
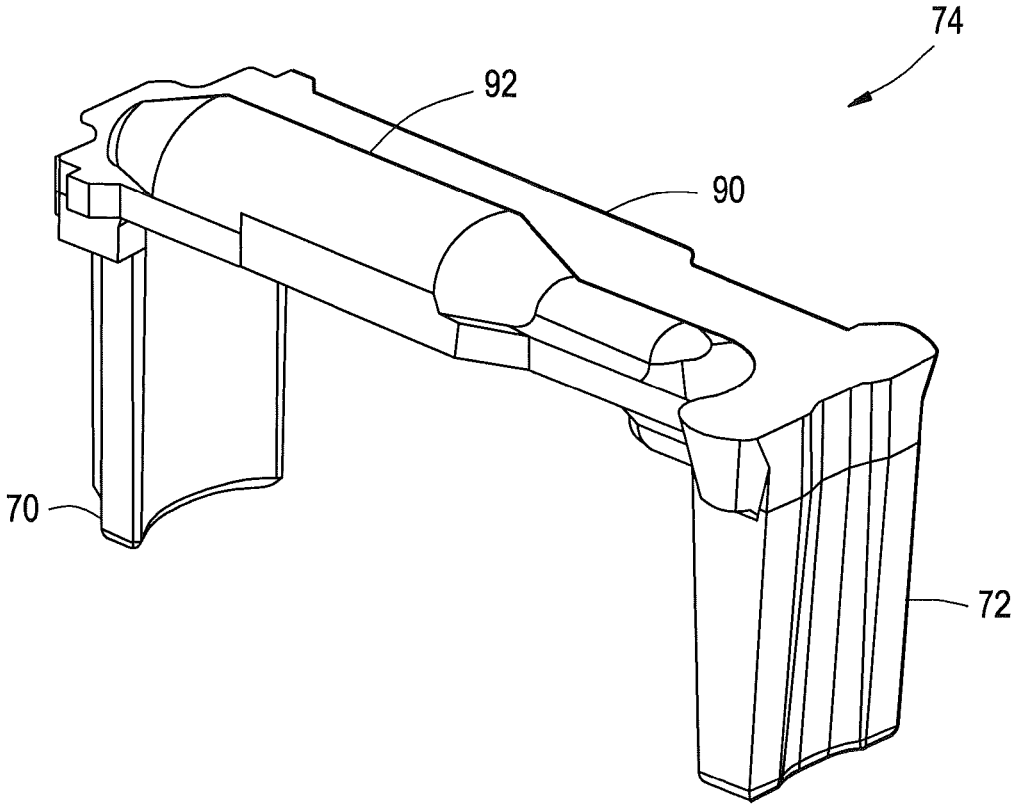
FIG. 10 is a perspective view illustration of the follower of the magazine of FIG. 1.
Figure 11:
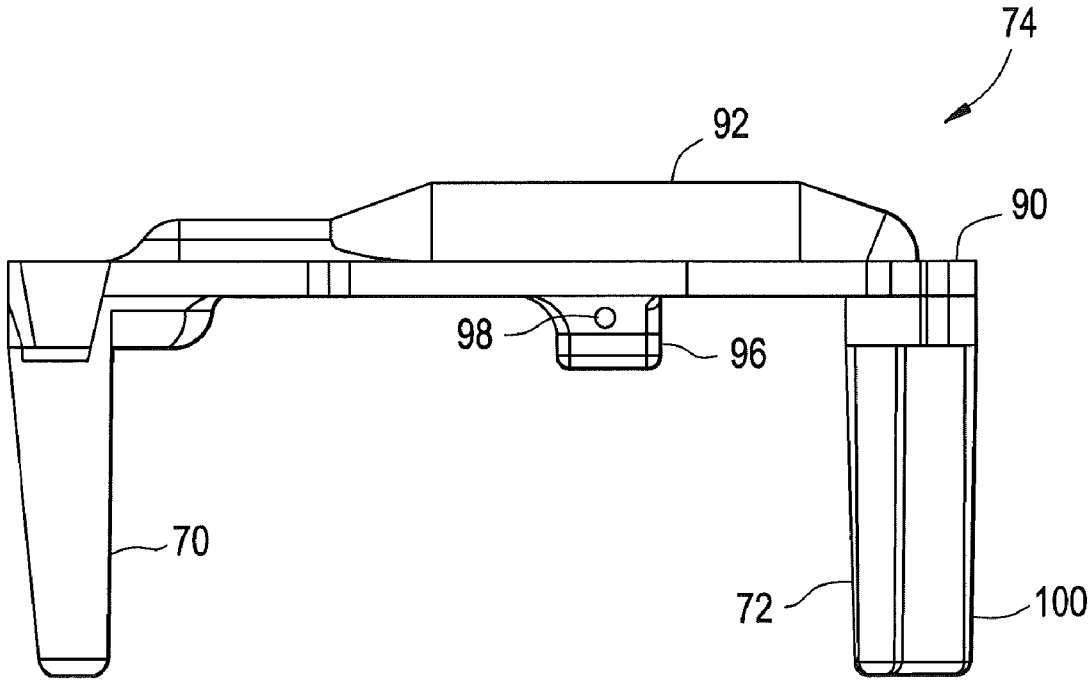
FIG. 11 is a side plan view illustration of the follower of FIG. 10; and, FIG. 12 is a bottom plan view illustration of the follower of FIG. 10.
Figure 12:
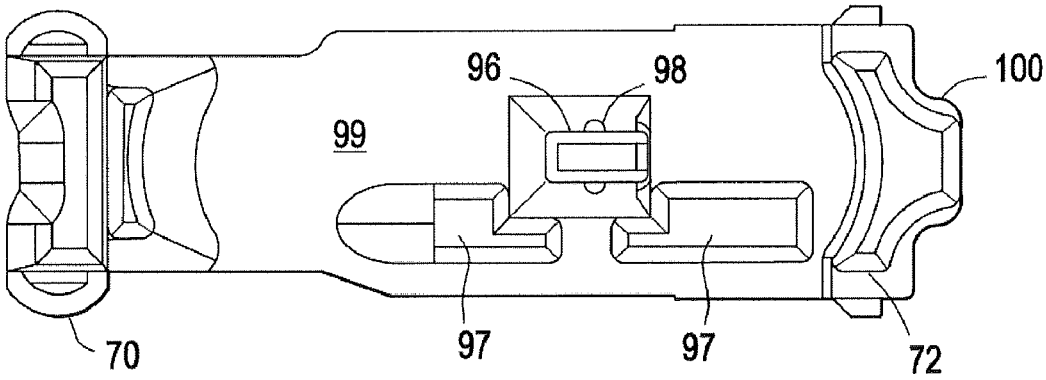

Referring now to FIG. 1, FIG. 2 and FIG. 9, the base 52 will be described. In the exemplary embodiment, the base 52 is molded from a plastic, such as a glass-filled nylon for example. The base 52 includes a top portion 56, a pair of longitudinal sides 58, and a pair of ends 60. A bottom portion 62 is connected to the sides 58 and ends 60. In the exemplary embodiment, the bottom portion 62 is angled relative to the top portion 56. The base 52 includes a plurality of cores or openings 64 formed in the top portion 56. In the exemplary embodiment, the openings 64 are blind holes having a bottom surface adjacent bottom portion 62. The top portion 56 also includes first opening 66 and a second opening 68 arranged on opposite ends of the top portion 56. The first opening 66 and the second opening 68 are sized to receive arms 70, 72 on follower 74 (see e.g. FIG. 5). As will be discussed in more detail below, in one embodiment, by sizing the openings 66, 68 to receive the arms 70, 72, advantages may be gained in preventing the user from inserting more than the allowable number of cartridges for a given size magazine box. It should further be appreciated that the openings 64, 66, 68 provide advantages in decreasing the weight of the magazine 20 and improve the manufacturability of the base 52.

The base 52 further includes a pair of slots 76, 78 that extend along the sides 58 adjacent and parallel to the top portion 56. The slots 76, 78 are sized to receive the projections 36 such that the top portion 56 is substantially within the opening 54 when the magazine box 26 is coupled to the base 52. A shoulder 80 is arranged at the end of each slot 76, 78. The shoulder 80 is sized to receive the notch portion 50 of magazine box 26. The notch portion 50 and shoulder 80 cooperate to locate the base 52 at the desired position when the magazine box 26 and base 52 are assembled. Extending transverse to slot 76 is a third slot 82 that extends from slot 76 through the top portion 56. As will be discussed in more detail herein, the third slot 82 is sized and positioned to receive the tab 38 when the base 52 is coupled to the magazine box 26. Opposite the third slot 82, a recess 84 extends substantially transverse to the slot 76. In the exemplary embodiment, the recess 84 includes an angled surface 86 that extends from side 58 to a desired depth. As will be discussed in more detail herein, the recess 84 is sized to allow a tool, such as a screwdriver, a coin or a key for example, to be inserted under the tab 38 to release the tab 38 from the third slot 82. This allows the disassembly of the magazine box 26 from the base 52 allowing the user to clean the magazine interior.

Referring now to FIGS. 1, 2 and 9-12, the follower 74 will be described. When assembled, the follower 74 is positioned within the interior portion 30 and is coupled to the base 52 by a biasing member, such as compression spring 88 for example. The follower 74 includes a platform portion 90 that extends substantially the length and the width of the interior portion 30. In the exemplary embodiment, the follower 74 may be molded from a suitable material, such as glass-filled nylon for example. A projection 92 extends from the platform portion 90. In the exemplary embodiment, the projection 92 is shaped to substantially similarly to half of a cartridges 22, such that the projection 92 provides an offset to properly align the staggered arrangement of cartridges as shown in FIG. 2.

The arms 70, 72 extend from each end of the platform portion 90. The arms 70, 72 are sized and shaped to reduce the potential for angling or tilting of the platform portion 90 as the cartridges are dispensed from the magazine 20. This provides advantages in reducing the potential for the cartridges 22 to jam making the magazine 20 inoperable. In one embodiment, the arm 72 is sized such that the distance 94 between the bottom of the arm 72 and the bottom of the second opening 68 is less than the diameter of a cartridge 22. This provides advantages in preventing the user from loading more than the permissible number of cartridges in the magazine. In the exemplary embodiment, the arm 72 may further include a raised portion 100 that corresponds to the shape of opening 66 is base 52. The follower 74 further includes a projection 96 from the surface 99 opposite the projection 92. The projection 96 includes a hole 98 that is sized to receive and retain the end of compression spring 88. The follower 74 may further include recesses 97 adjacent to the projection 96. The recesses 97 aid in improving the manufacturability of the molded follower 74.

Figure 4:
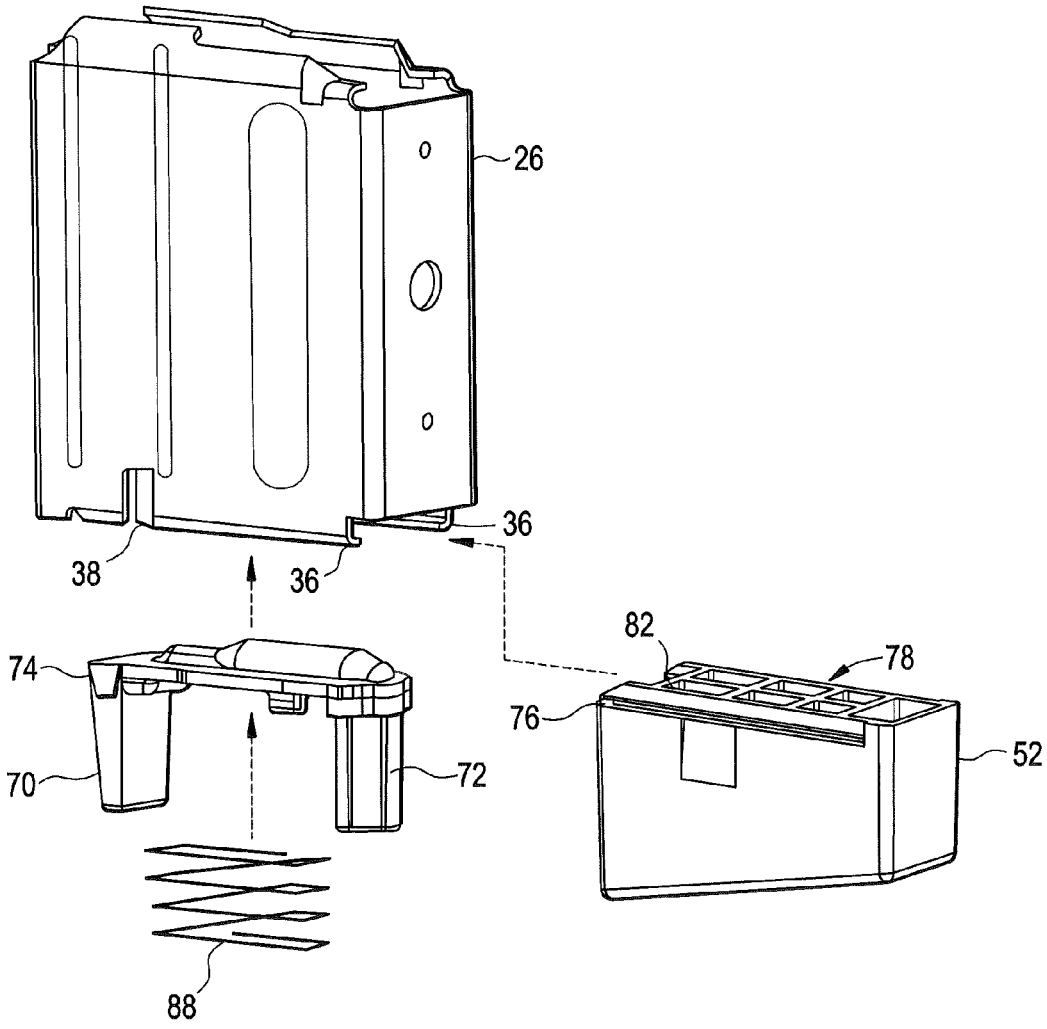
FIG. 4 is an exploded perspective view illustration of the magazine of FIG. 1.
Figure 7:
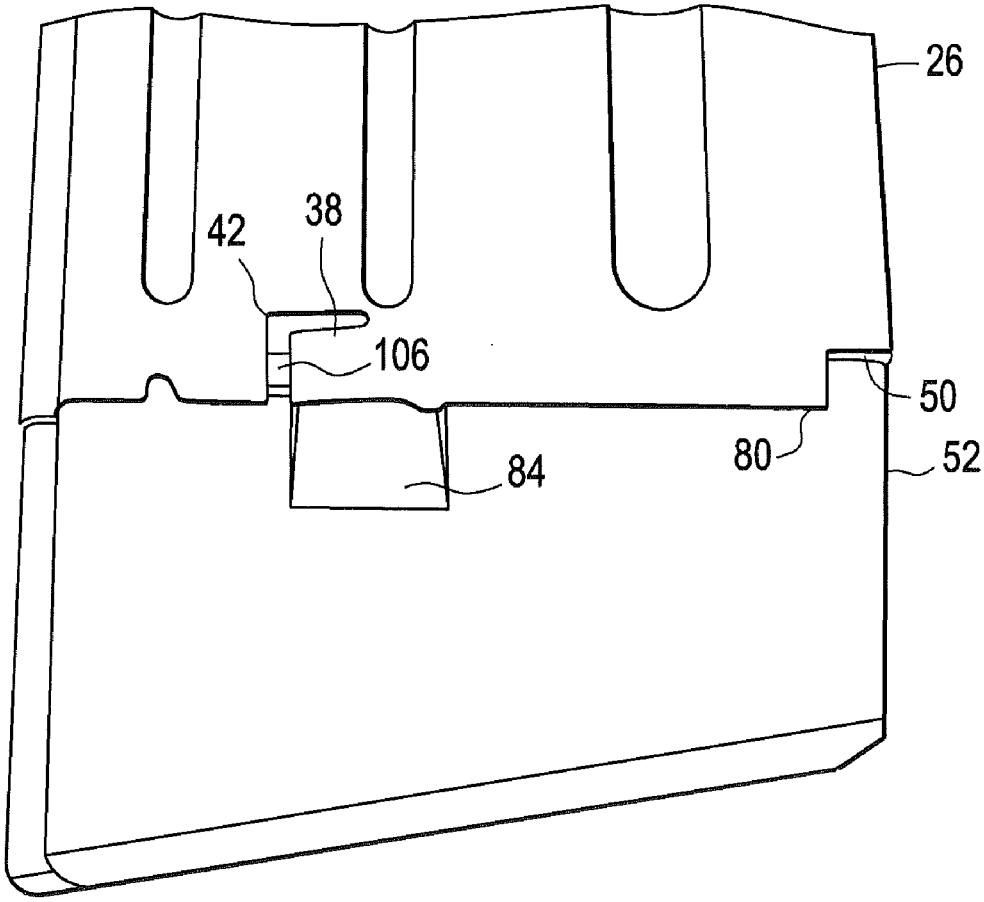
FIG. 7 is a partial side plan view illustration of the magazine of FIG. 1.

To assemble the magazine 20, the user attaches the spring 88 to the follower 74 and inserts the spring/follower subassembly into the interior portion 30 of the magazine box 26 as indicated in FIG. 4. With the follower 74 and compression spring 88 installed, the slots 76, 78 of base 52 are disposed onto the projections 36 and the shoulder 80 is moved towards the notch portion 50. As the leading edge 102 of top portion 56 engages the tab 38, the tab 38 deflects and slides along a surface 104 arranged between the slot 76 and the top portion 56. As the base 52 continues to slide towards the closed position, once the tab 38 clears the edge of the third slot 82 the tab 38 will deflect back to its original position as shown in FIG. 7. Further movement of the base 52 is prevented by the engagement of the shoulder 80 with the notch portion 50. It should be appreciated that once the tab 38 enters the third slot 82, movement of the base 52 towards the open position is prevented as the end 42 of the tab 38 will engage the sidewall 106 of third slot 82.

Figure 5:
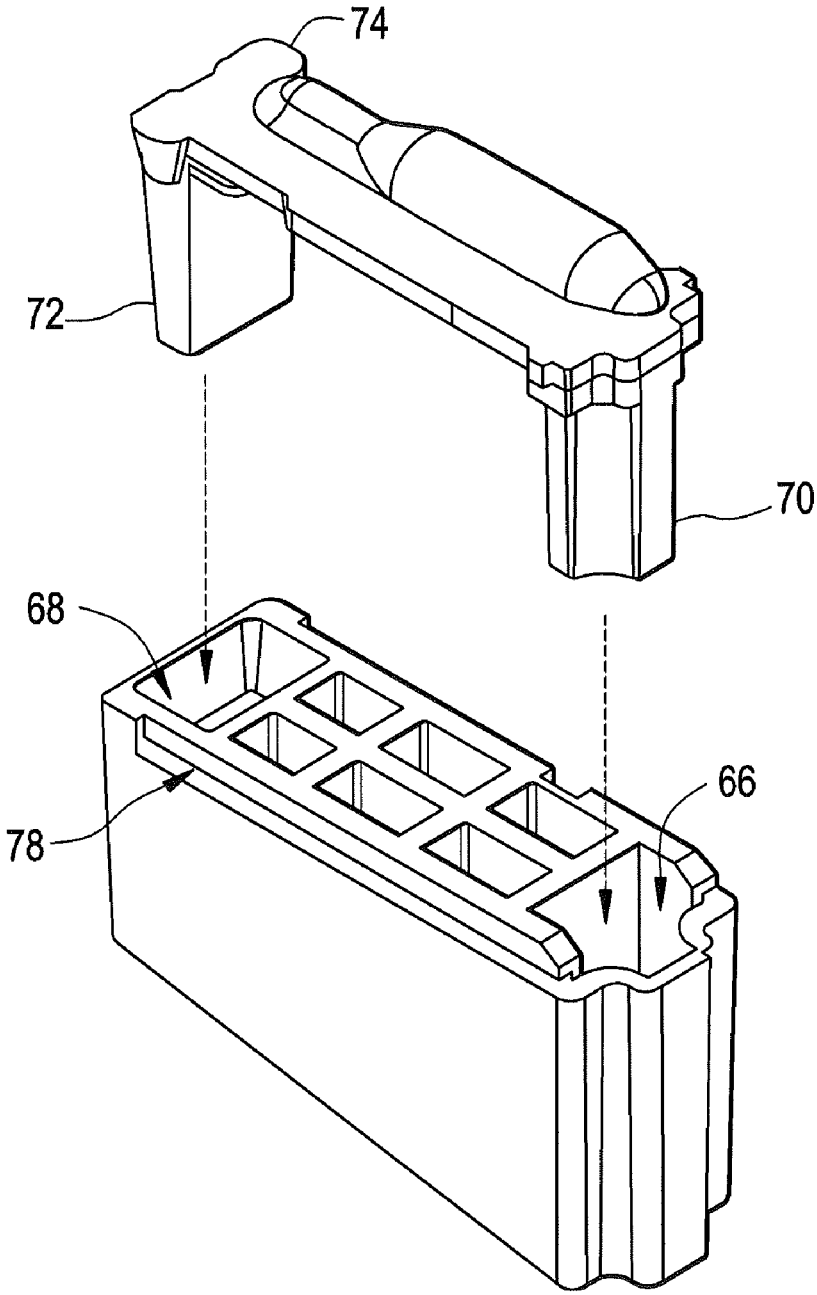
FIG. 5 is an exploded perspective view of the follower and base of FIG. 4.
Figure 6:
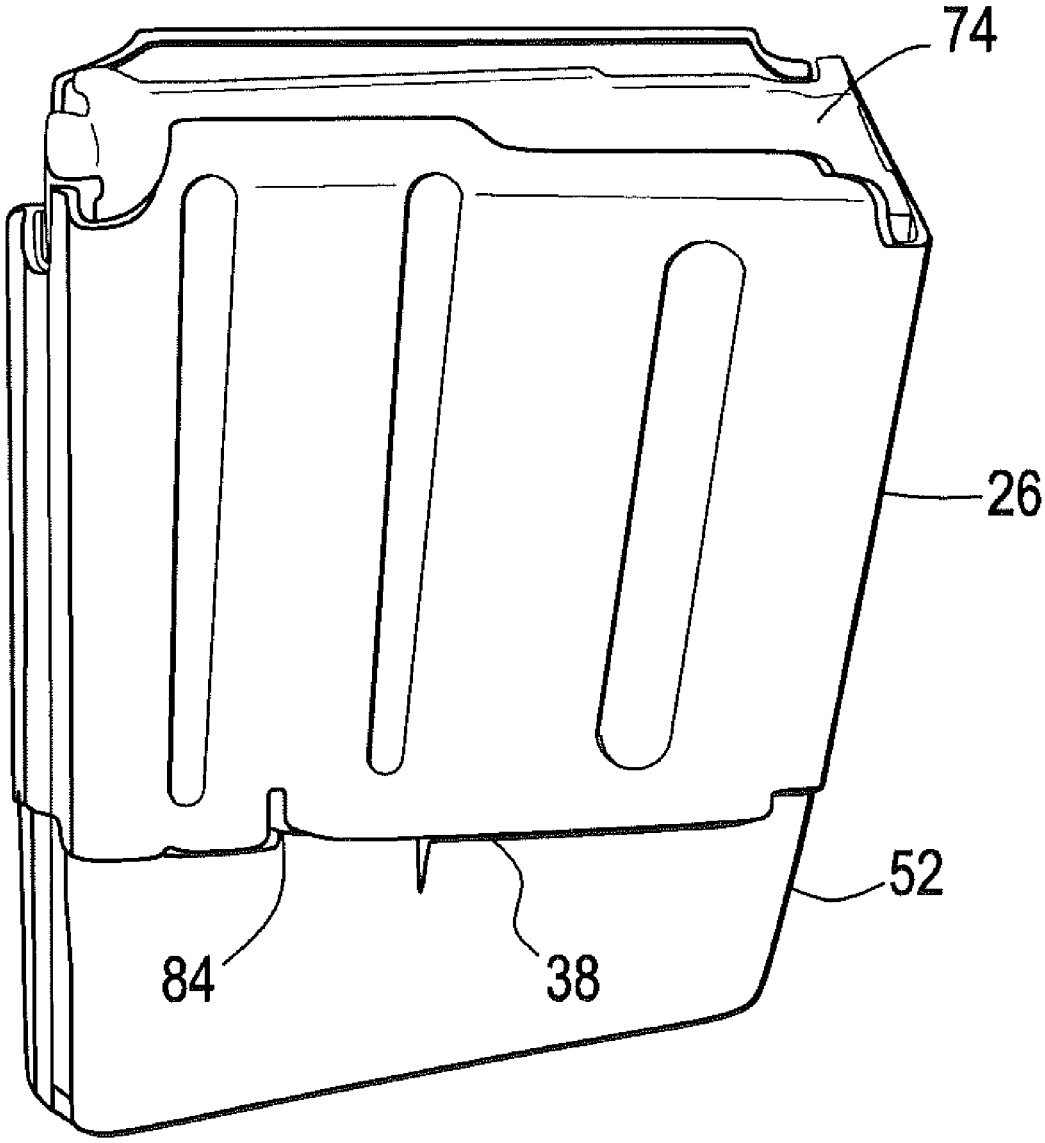
FIG. 6 is a perspective view illustration of the magazine of FIG. 1.

With the base 52 installed, the user may then insert cartridges 22 into the magazine 20 via the opening 24. As the cartridges 22 are inserted, the follower 74 moves away from the opening 24 within the interior portion 30 of the magazine box 26 and compresses the spring 88. As the follower 74 moves within the magazine box 26, the arms 70, 72 slide into first and second openings 66, 68 as shown in FIG. 5. In one embodiment, when the predetermined number of cartridges 22 (e.g. ten cartridges) have been inserted, the distance between the surface 99 and the top portion 56 is less than the diameter of one cartridge 22. This aids in preventing the modification of the follower 74 and/or the base 52 to accept additional cartridges.

Periodically, the user may need to clean the magazine 20 to remove accumulated debris and contaminants. To clean the magazine 20, the user typically removes the base 54. To remove the base 54, the user disengages the tab 38 by inserting a tool (not shown) into the recess 84 through the slot 76 and under the tab 38. The tool may then be used to deflect the tab 38 allowing it to slide past the sidewall 106. Once the tab 38 has been moved past the sidewall 106 the tool may be removed and the base 52 disengaged from the magazine box 26.

In some jurisdictions, regulations have been promulgated that limit the capacity of the magazine 20 to a predetermined number of cartridges. For example, in some states, it is unlawful to sell a firearm with a magazine having a capacity of more than 10 cartridges or sell a magazine that may be modified to hold more than 10 cartridges. The magazine 20 includes features that inhibit end users from modifying the magazine 20 to increase its capacity beyond the intended amount for given size magazine box 26 and the space of interior portion 30. In order for the capacity to be increased, the user would need to increase the amount of space in the interior portion 30. In the exemplary embodiment, the projection 96 contacts the top portion 56 before an additional cartridge can be inserted. In another embodiment, the solid height of the compression spring 88 is less than the diameter of a cartridge 22, as such, the compression spring 88 prevents additional cartridges 22 from being inserted. If the user attempts to modify the compression spring 88 by reducing the number of turns, the compression spring 88 will not have the desired properties to bias the cartridges toward the opening 24. In another embodiment, the distance 94 is less than a diameter of a cartridge, as a result, the arm 72 will contact the bottom of the second opening 68 preventing the insert of the additional cartridge.

The user may also attempt to modify the base 52 to move the follower 74 lower in the interior portion 30. However, if the user removes material from the top portion 56, the wall thickness between the top portion 56 and the slots 76, 78 will be reduced. In the exemplary embodiment, this thickness is selected such that if the user removes material from the top portion 56, the wall thickness between the slots 76, 78 will be insufficient to support the load of the compression spring 88 and will crack or fail. Once the wall of base 52 cracks, the base 52 will no longer be attached to the magazine box 26 and the magazine 20 may cease to function properly. It should be appreciated that these features in combination both singularly and in combination provide advantages in preventing the user from modifying the magazine 20 to hold more than the allowable number of cartridges 22.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A magazine comprising:

a base having a first side and a second side said base further having a first opening and a second opening extending generally parallel to said first side and said second side;

a magazine box removably coupled to said base and sized to receive a predetermined number of ammunition cartridges;

a follower movably disposed in said magazine box between a first position and a second position, said follower having a first arm and a second arm, wherein said first arm and said second arm are arranged in said first opening and said second opening when said follower is in a first position; and, a biasing member arranged between said follower and said base.

2. The magazine of claim 1 wherein said base further includes a first slot disposed on said first side and a second slot disposed on said second side, wherein said magazine box further includes a pair of projections on one end, said pair of projections being sized to be received in said first slot and second slot.

3. The magazine of claim 2 wherein:

said base further includes a third slot transverse said first slot; and, said magazine box includes a tab arranged adjacent to one of said pair of projections, said tab being sized to be received in said third slot.

4. The magazine of claim 3 wherein said tab extends on an angle relative to said pair of projections.

5. The magazine of claim 4 wherein said base further includes a recess adjacent said third slot, said recess being arranged opposite said first slot.

6. The magazine of claim 5 wherein said biasing member is a compression spring coupled on one end to said follower.

7. A magazine comprising:

a base having a first side, a second side and a first end extending between said first side and said second side, said first end includes a second opening and a third opening, said second opening is sized to receive said first arm and said third opening is sized to receive said second arm; and, to prevent the insertion of more than said predetermined number of ammunition cartridges in said magazine box, said first side having a first slot adjacent said first end and said second side having a second slot adjacent said first end, said base further having a third slot extending transverse to said first slot;

a magazine box slidably coupled to said base, said magazine box is sized to receive a predetermined number of ammunition cartridges, said magazine box having a first projection and a second projection extending from one end, said first projection and said second projection being sized to be received in said first slot and said second slot, said magazine box further having a tab extending from said first projection on an angle towards said second projection, said tab being arranged to be received in said third slot when said magazine box is coupled to said base;

a follower disposed in said magazine box; said follower includes a first surface engaging said ammunition cartridges, a second surface opposite said first surface, and a first arm and a second arm adjacent said second surface, said follower being movable between a first position when said predetermined number of ammunition cartridges are within said magazine box and a second position; and, a biasing member coupled to said follower and arranged between said follower and said base.

8. The magazine of claim 7 wherein said magazine box includes a notch adjacent said first projection and said second projection, and said first projection and said second projection define a first opening, said first opening being sized to receive said base.

9. The magazine of claim 8 wherein said base further includes a shoulder extending from said first end, wherein said notch is adjacent said shoulder when said magazine box is coupled to said base.

10. The magazine of claim 7 wherein said base further includes a recess extending transverse to said first slot, said recess being adjacent to said third slot.

11. The magazine of claim 10 wherein said recess includes an angled surface.

12. The magazine of claim 7 wherein said distance is less than a diameter of an ammunition cartridge.

13. A magazine comprising:

a base having a first side and an opposing second side, a first end and an opposing second end disposed between said first side and said second side, and a third end disposed in communication with said first side, said second side, said first end and said second end, said third end having a first opening an a second opening therein, wherein said base includes a first slot in said first side and a second slot in said second side, said first slot and said second slot each having an open end adjacent said first end, and said base having a third slot in said first side, said third slot being arranged substantially perpendicular to said first slot;

a magazine box having an ammunition cartridge volume sized to receive a predetermined number of ammunition cartridges, said magazine box having a first projection and a second projection arranged on one end, said first projection and said second projection being sized to be received in said first slot and said second slot, said first projection and said second projection defining a third opening sized to receive said third end;

a follower movably disposed in said ammunition cartridge volume between a first position and a second position, said follower having a first arm and a second arm, wherein said first arm and said second arm are arranged in said first opening and said second opening when said follower is in said first position and are substantially in said ammunition cartridge volume when said follower is in said second position; and, a biasing member disposed between said follower and said third end.

14. The magazine of claim 13 wherein said magazine box further includes a tab extending from adjacent said first projection towards said second projection.

15. The magazine of claim 14 wherein said magazine box is slidable from a third position to a fourth position relative to said base, wherein said tab engages said first side in said third position and is disposed in said third slot when said magazine box is in said fourth position.

16. The magazine of claim 15 wherein said base further includes a recess adjoining said first slot, said recess being sized to receive a tool.

17. The magazine of claim 16 wherein said magazine box is slidable from said fourth position to said third position when said tab is disengaged from said third slot.

18. The magazine of claim 17 wherein:

said magazine box includes a notch portion adjacent said first projection and said second projection; and said shoulder includes a shoulder sized to receive said notch portion when said magazine box is in said fourth position.

19. The magazine of claim 18 wherein said biasing member is a compression spring.

* * * * *